US007972142B2

(12) United States Patent
Swiatek et al.

(10) Patent No.: US 7,972,142 B2
(45) Date of Patent: Jul. 5, 2011

(54) VEHICLE BATTERY TERMINAL EXPANSION AND POWER DISTRIBUTION DEVICE

(76) Inventors: John Albert Swiatek, Shelby Township, MI (US); Adam Stephen Bonislawski, Sterling Heights, MI (US)

( * ) Notice: Subject to any disclaimer, the term of this patent is extended or adjusted under 35 U.S.C. 154(b) by 0 days.

(21) Appl. No.: 12/706,673

(22) Filed: Feb. 16, 2010

(65) Prior Publication Data

US 2010/0210150 A1 Aug. 19, 2010

Related U.S. Application Data

(60) Provisional application No. 61/152,296, filed on Feb. 13, 2009.

(51) Int. Cl.
*H01R 33/00* (2006.01)

(52) U.S. Cl. ..... 439/34

(58) Field of Classification Search ..... 439/34, 439/36, 504, 957, 763, 620.26
See application file for complete search history.

(56) References Cited

U.S. PATENT DOCUMENTS 4,354,726 A * 10/1982 Kato et al. ..... 439/763
4,473,251 A * 9/1984 Murayama ..... 296/78.1
4,597,270 A * 7/1986 Kerr ..... 62/138
4,884,050 A * 11/1989 Kozel ..... 337/264
4,936,796 A * 6/1990 Anderson, Jr. ..... 439/620.21
6,104,099 A * 8/2000 Mizuta et al. ..... 307/9.1
6,783,040 B2 * 8/2004 Batchelor ..... 224/413
7,271,760 B2 * 9/2007 Bartosik et al. ..... 342/20
2007/0026738 A1 * 2/2007 Eichman ..... 439/620.29

* cited by examiner

*Primary Examiner* — Phuong K Dinh
(74) *Attorney, Agent, or Firm* — Cargill & Associates, PLLC; Lynn E. Cargill

(57) ABSTRACT

A remote battery terminal expander for electrically connecting a plurality of appliances to a vehicle battery is disclosed that includes an electrical terminator assembly having a permanent electrical communication with a wire, where the terminator is adapted for electrical connection to the positive terminal of a battery and this terminator assembly is permanently attached to a conductive metal terminal block. The terminal block has a multi-sided block shape, usually with a rectangular shape. The plurality of appliances are in electrical communication with the electrical terminator assembly by use of alternating threaded apertures in each of the sides for receiving threaded fasteners to electrically secure the appliance wires from the plurality of appliances desired to be hooked to the vehicle battery for its power requirements. For safety sake, a fuse assembly is placed in electrical communication between the electrical terminator assembly and the conductive metal terminal block so that the appliance wires can be secured to the terminal block in a non-90° configuration, such that space is saved and a multitude of connections can be made in a small amount of space, without stacking all the connectors onto the positive and negative battery terminals.

17 Claims, 4 Drawing Sheets

VEHICLE BATTERY TERMINAL EXPANSION AND POWER DISTRIBUTION DEVICE

CROSS REFERENCES TO RELATED APPLICATIONS

This application claims the benefit under 35 U.S.C. 119(e) of U.S. Provisional Application No. 61/152,296 filed on Feb. 13, 2009.

TECHNICAL FIELD

This invention relates to electrical connectors to be installed on vehicles, and more particularly, to a remote battery terminal expander and power distribution device between a power supply in the vehicle and one or more plug-in electrically powered accessories and appliances that users want on various vehicles where there is very little space for electrical connections, such as motorcycles, snowmobiles, wheelchairs, hi-lo's, all terrain vehicles, construction equipment, personal watercraft, and boats, among others.

BACKGROUND OF THE INVENTION

Conventional methods and devices for powering a multitude of all the new portable electrical devices into a vehicle have caused a lot of problems. Now can someone on a motorcycle, snowmobile, all-terrain vehicle (ATV) or off-road vehicle plug in their cell phone? If they have a factory installed cigarette lighter socket, they can plug one appliance into that, but what if they want to use multiple devices, such as when they want to use their MP3 device while they are recharging their cell phone? Add to that a GPS unit, radar detector, heated vest plug or intercom system and now you have real trouble prioritizing which device you can power up.

When any vehicle, besides a full size automobile, is in use, there is a space consideration for being able to install and operate electrical connections, especially while the vehicle is moving. Since space is limited in these vehicles, the same solutions are not available as those that can be implemented on a full size vehicle. Full size connectors will not fit for many of the smaller vehicle types. Furthermore, since the connections themselves are usually exposed to the outer elements, greater protections are advantageous.

As you know, new portable powered accessories have become very popular in the current economy. Portable powered accessories may include many things such as cell phones, GPS units, personal audio/CD/MP3 stereo systems, satellite radios, radar detectors, laptop computers, heated vests and any number of other portable accessories. As more and more people acquire these accessories, they want to bring them on their adventures. Additionally, people want to become more and more mobile in their business and they would like to be able to work when they are on the go, such as when they are driving powersport vehicles, including motorcycles, snowmobiles, boats, or any other vehicle. For instance, 20 years ago, a conventional real estate executive would have to stay in his office in order to make a living. Now, however, such professionals can go on the road on their motorcycle and still make a living. Manufacturer's representatives and salesmen are able to close deals while out on their boat or out on the road. However, to be able to do business, the list of necessary appliances keeps on growing.

More and more powersport enthusiasts are utilizing navigational equipment, including global positioning system units, satellite radios and are also using wireless communication systems between riders on separate vehicles, which can be very important. Further, motorcyclists and snowmobilers and ATV operators have wireless communication systems to be utilized between the driver and the passenger, as well as the driver of one vehicle to the driver or passenger of another vehicle.

Due to the multitude of plug-in appliances, there is a logistical and safety problem with using all of these appliances and accessories because there are no quick and easy electrical connections to the battery or motor of the vehicle that they are operating. In a full sized vehicle, like four-wheel drive SUV automobiles, there is much more space for electrical connections, and they are factory installed. For example, there are now option packages that provide cigarette sockets in multiple configurations, and in many different locations within the console. However, for any other type of vehicle, such as motorcycles, snowmobiles, all terrain vehicles, wheelchairs, hi-lo's, construction equipment, personal watercraft, and boats, among others, where space is a real concern the person using the cell phone or the other appliance is left to their own devices in order to find a way to recharge the batteries of their accessories and/or use it on the vehicle.

For instance, large land cruising motorcycles can be ridden for weeks on end during long cross country trips, and it would be advantageous for a motorcycle rider to have access to his electrical devices including a cell phone, GPS, his laptop computer, electrically heated clothing or his personal audio/stereo system, while he is riding. Traditionally, motorcyclists, snowmobile riders or personal watercraft drivers were generally required to either wholly or partially disassemble the top half of their vehicles in order to gain access to the battery terminals for power charging any of their accessories. Besides, the loose wires coming off the battery would be a dangling hazard around the motor and all the other moving parts. That creates a large problem for the enthusiast that has all the "toys" he wants to use, but is unable to use them while he is riding.

Therefore, motorcyclists, snowmobilers, boaters or any other powersport vehicle enthusiast would like to have a simple solution at his disposal for the wiring needed to power multiple electrical devices to one vehicle battery. As one can imagine, there is a practical limit to how many power cables can be connected to one set of battery terminals. Although one or two electrical devices hooked to power cables may be practical, three or more becomes difficult to manage.

As one can also imagine, a problem arises when mounting any of the selection of larger conventional fuseblocks to expand the number of connection points for most of the low volt 12-volt appliances and accessories desired by these enthusiasts. There isn't enough space close to the battery, so the fuseblocks need to be mounted too far from the desired place. Most of the conventional fuseblocks are too large to install in tight locations on their vehicles even if they have custom made mounting plates. If they had the space, installation would require drilling holes into the vehicle frame, along with a variety of time consuming steps that would require a skilled craftsman. For example, a conventional fuseblock may be 4 inches by 6 inches by 1 inch high.

Often times, identifying a suitable mounting location is not possible, as today's vehicles do not have much "open-space" or "real estate". Next, the manufacturing of a suitable mounting plate would be often beyond the skills of a common person. At the very least, it would be a time consuming process. Once the fuseblock is mounted, it would require custom wiring to be connected to the battery terminals of the motorcycle, again, where a skilled person would be required to devote their time and materials to manufacture these cables. Finally, to finish the installation, the power cords for the electrical devices would have to be terminated at the fuseblock.

It is envisioned by the present inventors that it would be most desirable to have a well-secured, simply mounted, electrically isolated, fuse-protected, termination point for terminating the electrical devices' power cables. Once installed, the invention may be easily accessed by the motorcyclist and new devices can be added or removed. These are in addition to heat sources for a plug-in vest, an electrical source to recharge a cell phone, an electrical source for a laptop computer, or as a receiving socket to be used for hooking up a battery charger during the winter to charge the battery on a motorcycle or charging the battery during the summer on a snowmobile.

When considering all the possibilities of low voltage items that can be purchased, there is a multitude of interconnecting wire that may be utilized. It would be very desirable for a powersport enthusiast to have a simple method at his or her disposal to connect all of their appliances and accessories to the vehicle battery terminals, as well as one that fits in confined spaces and can be installed without the need for special tools or skills.

SUMMARY OF THE INVENTION

In accordance with the present invention, there are several aspects for solving some of the problems addressed hereinabove. In a first aspect of the present invention, a new type of battery terminal expander and power distribution device is provided with a capacity for making multiple electrical connections. In this aspect of the battery terminal expander, a battery terminal expander comprises an electrical terminator assembly, a conductive metal terminal block and a fuse assembly adapted for being received on a vehicle that is in a simple form for multiple wire attachments in a safe, fused manner. The instant battery terminal expander is capable of providing all its connections without any 90° installations, which takes a lot more space. In this aspect of the present invention, up to 8 or more different devices can easily be connected to the fuseblock.

These achievements, i.e. the ability to wire up so many devices while utilizing a small space, with no 90° installations, along with the safety of fusing and operation after wiring the devices, renders this invention unique and unknown to anyone in this art. While appearing simple, it took an inventive leap to achieve the simplicity while still functioning and providing safety.

The present invention is a specialized battery terminal expander and power distribution device that quickly mounts to any vehicle battery terminal without the need for specialized skills or tools and includes both a fuse and a terminal block or electrical device power cable mounting point. It will act as a remote battery terminal expansion so that once it is installed on the vehicle, plugging in additional devices away from the battery will be simple. There will be no need to disassemble the vehicle and try to secure several wires onto the pre-existing battery terminal. If one can imagine trying to attach, for example, a cord from an appliance onto the battery of a motorcycle or wheelchair most people would feel very confused. So, to begin, they would need to access the battery, and then finish by trying to run wires. With the present invention, the wires can be installed, and an exposed electrical connector, such as a socket, can be ready for connection.

Otherwise, in order to access the battery, the first thing one must usually do is to first find the battery and access it. In motorcycles and ATV's, usually this means lifting up the seat of the motorcycle, and, depending on the motorcycle, one would have to gain access underneath the gas tank, or perhaps partially remove some of the fairing, if a racing motorcycle is utilized, because the battery is moved far forward in the frame in order to balance out the weight in the hike. Then, one would have to re-fabricate a new battery terminal in order to add enough securement devices to accommodate a plurality of appliances that the operator wants to attach to the battery terminal. Since the devices do not have their own fuses, the operator would then also need to provide a fuseblock, commonly available from motorcycle accessory and electrical appliance stores. Such a fuseblock requires the securement of the positive terminal of a wire set at a 90° angle, meaning that each of the five appliances would require a 90° configuration in order to be powered up. This 90° configuration requires a lot of space, and would be dangling from the side of the motorcycle, rendering an unsafe situation.

Furthermore, all of the wires would be exposed to the outer elements and subject to being in the way of the operator and/or any passenger that may be mounting and un-mounting from the vehicle. Imagine, again, that you live in a wheelchair, and that you may need several power appliances, such as an oxygen tank, heart monitors, Halters monitor, or any number of medical powered devices used for your survival. In this case, a remote battery terminal expander unit would be very desirable without having to reconfigure the battery terminals, fuseblocks, and possible fabrications in order to accommodate a large number of appliances.

Until now, the concept of terminating power cords for multiple electrical devices to one battery has not been envisioned this compact or simply. This device offers many advantages including, but not limited to, being safe to use, quick to install with tie-wraps, reducing the need For excess cables, reducing a need for more space needed for mounting the fuseblock and adapter plate, as well as simplifying installation for mechanics in dealerships.

The detail of this power distribution device embodies unique aspects for the powersport enthusiast. The next aspect is the ability to locate the terminal block of the invention in a convenient location. This invention has the unique advantage of keeping its conductive terminal block small, thereby allowing a wider selection of mounting locations. This allows the consumer to be able to access the conductive terminal block to be serviced more easily, as many of the vehicle batteries on newer vehicles are increasingly more difficult to access.

The next unique aspect in this embodiment of the present invention is the "in-line" nature of the field wiring on the conductive terminal block. This allows for a quicker, cleaner, more simplified wiring installation. Having a rubber boot slide over the terminals as they are attached to the conductive terminal block quickly isolates the terminal block electrically from other conductors such as the vehicle frame. A further unique aspect is that the device does not require fabricating of any specialized mounting systems. Common tic-wraps may be used to quickly and securely mount the invention. Finally, service can be performed without the need to access the battery. Simple removal of the fuse from the fuse holder terminates all electrical connection and allows the terminal block and electrical device power cable wiring to be serviced safely.

The present invention provides a novel means to add multiple accessories to one vehicle battery, while still being universally applicable to all vehicles with a minimized installation time. Convenient locations for use are made available, as well as making the connections safe, simple and preferably fused. Necessary power can be provided to low voltage (12 volt) electronic appliances, or to charge the vehicle battery from an external battery charger. The vehicle does not need to be permanently modified to install the device, as there is no need for drilling holes in the vehicle, nor modifying the OEM wiring. Further, the battery terminal expander has a clean appearance and is visually pleasing while providing the necessary power for accessories, up to 24 amps of current at 12 volts, to power almost any accessory known.

Although the invention will be described by way of examples hereinbelow for specific embodiments having certain features, it must also be realized that minor modifications that do not require undo experimentation on the part of the practitioner are covered within the scope and breadth of this invention. Additional advantages and other novel features of the present invention will be set forth in the description that follows and in particular will be apparent to those skilled in the art upon examination or may be learned within the practice of the invention. Therefore, the invention is capable of many other different embodiments and its details are capable of modifications of various aspects which will be obvious to those of ordinary skill in the art all without departing from the spirit of the present invention. Accordingly, the rest of the description will be regarded as illustrative rather than restrictive.

BRIEF DESCRIPTION OF THE DRAWINGS

For a further understanding of the nature and advantages of the expected scope and various embodiments of the present invention, reference shall be made to the following detailed description, and when taken in conjunction with the accompanying drawings, in which like parts are given the same reference numerals, and wherein.

DETAILED DESCRIPTION OF THE INVENTION

The present invention discloses a vehicle battery terminal expander and power distribution device attachable to a vehicle with a power source so that a plurality of appliances can be electrically connected to the power source in a minimum of space without undue burden or difficulty. The present invention provides a new and ingenious device for providing such a connection that will fit a large multitude of models of vehicles, including motorcycles, all terrain vehicles (ATV's), four wheel off-road or other utility terrain vehicles, such as UTV's, wheelchairs, hi-lo's, jet boats, snowmobiles, golf carts and the like.

In that regard, although the present invention will work the same way on all of the above mentioned vehicles, the examples and drawings below relate to installation of the present invention on a motorcycle for ease of discussion. For the other vehicles that the invention can be used for the positive wire and the negative wire will still be attached to the battery or power source in each of those vehicles. With that in mind, we now look at the drawings.

Figure 1:
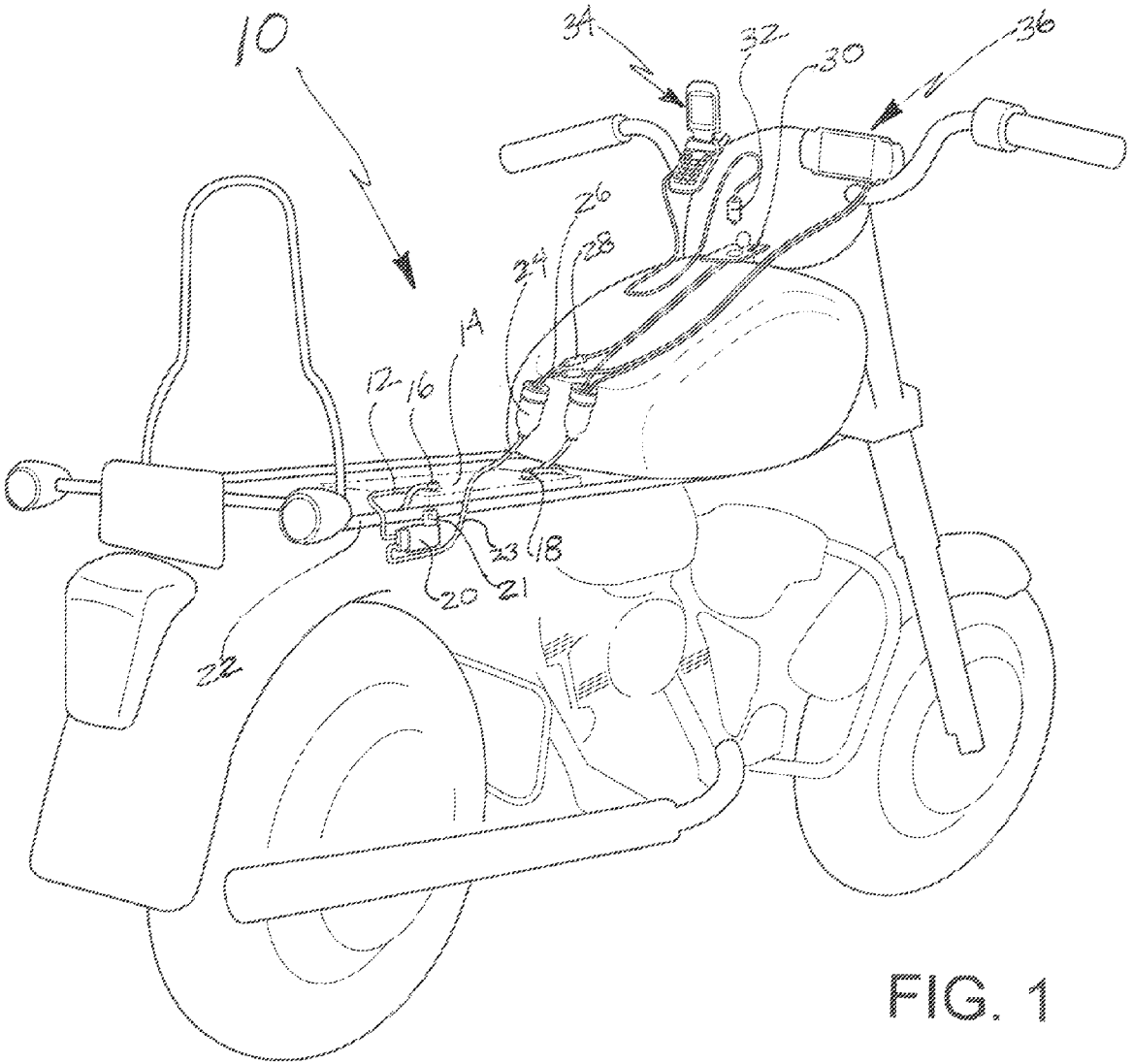
FIG. 1 is an environmental perspective view of a first aspect of a battery terminal expander and power distribution device installed on a motorcycle made in accordance with the present invention.
Figure 2:
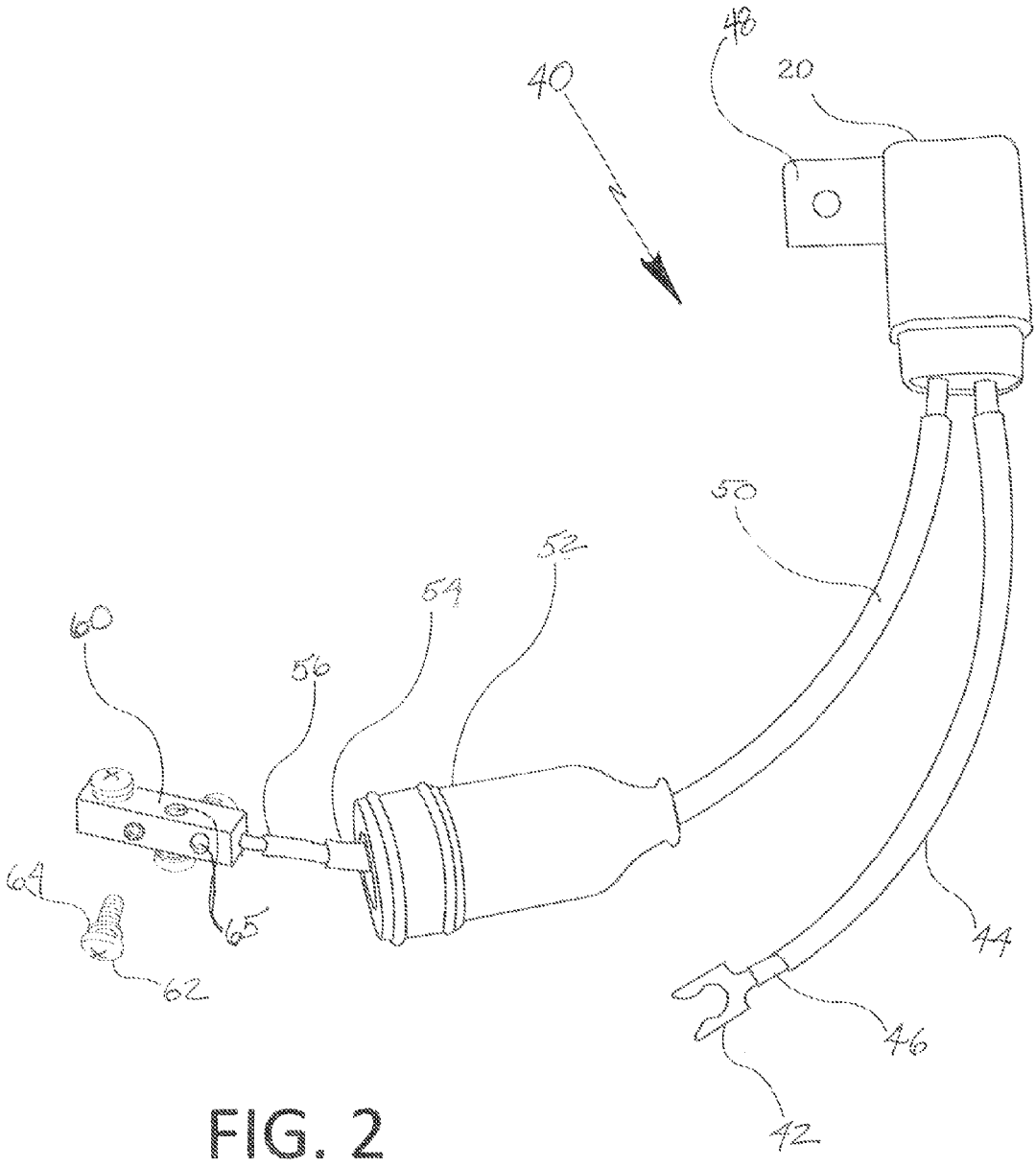
FIG. 2 details a battery terminal expander in its most basic form.

Referring now to the drawings, in detail, FIG. 1 is an environmental perspective view of a motorcycle with the battery terminal expander and power distribution device of the present invention installed thereon, as generally indicated by the numeral 10. Motorcycle and battery terminal expander combination 10 includes a positive wire 12 attached to battery 14 on the positive battery terminal 16 with a electrical terminator (not shown here). Positive wire 12 terminates in fuse holder 20 that has a fuse holder bracket 21 attached thereto. Bracket 21 can be used to fasten the fuse holder 20 onto other wires with tie-wraps, or it may be fastened to a frame member 22 of the motorcycle, and would attach to any frame of the abovementioned vehicles other than the motorcycle in a similar fashion. The positive wire is sized and adapted to place the fuse holder in a position for ease of replacement and use.

From the fuse holder, wire 23 extends to rubber boot 24 and passes into the boot for a termination. The termination occurs on a termination block which is not Shown in this diagram, but will be disclosed further hereinbelow with reference to FIGS. 1-4. Wire bundle 26 emerges from within rubber boot 24 and may include an optional in-line fuse 28 before it terminates at the socket 30. Socket is located in, near or around the handlebars of the motorcycle for ease of use while driving. Appliance 34 may include any appliance, such as the cell phone shown, or it may be any other appliance including, but not limited to, MP3 players, GPS units, satellite radios, stereo components, cords for heated clothing, lights, or anything else that needs to be hooked up to the battery. The appliance charging cord will usually include a plug 32 for plugging into such a socket as socket 30.

For a device that can be more permanently wired to the battery, such as the GPS unit shown by numeral 36, the wire from the GPS can go directly from the GPS into the termination point inside rubber boot 24. This demonstrates the versatility of the present invention, because any electrical configuration can be accommodated, whether the appliance needs to be plugged into a socket, or whether it was intended to be wired to the battery. Such flexibility is one of the best features here. Either way, the present invention can more easily be installed than prior art devices. One configuration of battery terminal expander can accommodate hundreds of different models of vehicles. Otherwise, there could be hundreds of different pieces that would need to be stocked by a motorcycle or accessory store for each application. Further, those prior art devices generally required a lot of fabrication for brackets and cutting into the frames of the vehicles in order to attach the wires. As discussed hereinabove, the present invention uses less space for its connections, so it can fit easily into tiny compartments Looking now to FIGS. 2 and 3, another aspect of the present invention is shown as a battery terminal expander is generally denoted by numeral 40, and can be seen to include a uniquely styled termination block 60. Starting from the battery terminal electrical connector 42, shown here as a fork terminal, even though it may be any type of terminal, like a ring terminal, a wire is permanently attached and adapted by electrical connection to the positive terminal of the battery. This may include an electrical terminator assembly having a permanent electrical communication with a wire, said terminator being adapted for electrical connection to the positive terminal of a battery. Wire 46 may be an 18 AWG to 12 AWG wire, wherein the wire has a temperature range of from 80° C. to 125° C. It may include one red wire 12 AWG with 105° C. that is PVC covered wire. Such a wire with a PVC coating sheath 44 protects it from the outer elements, such as UV light, and is oil and gas resistant, like all the other components as it is an exposed element itself. This wire 46 connects into fuse assembly 20. Assembly 20 may include a bracket 48 so that it may be attached, whether permanently by a fastener to a frame member of the vehicle, or loosely by a tie wrap to other wires or components (not shown). Wire 50 extends from the fuse assembly 20 and terminates at terminating block 60, which can be sleeved thereover by rubber boot 52, or its equivalent.

Conductive metal terminal block 60 may be made of any suitable conductive material, wherein the conductive metal terminal block may be made of any conductive material selected from the group consisting of copper, gold, silver, their alloys, and combinations thereof. Any other conductive material may be used. This conductive metal terminal block 60 preferably includes a multi-sided block shape with alternating threaded apertures in each of the sides for receiving threaded fasteners to electrically secure appliance wires from various of the plurality of appliances desired to be hooked to the vehicle battery for its power requirements. The block may also be an elongated rectangularly-sided block shape so as to accommodate up to 8 or more appliance wires.

The fuse assembly may be constructed of a fuse or a circuit breaker such as a commercially available fuse, circuit breaker, or the newer electronic cut-off switches or thermally re-settable circuit breakers. In short, the fuse or circuit breaker may be used to cut all power during maintenance of any of the appliances, without having to disassemble any of the wiring. This can be especially useful if the fuse assembly is located within easy reach when the vehicle is not moving.

Figure 3:
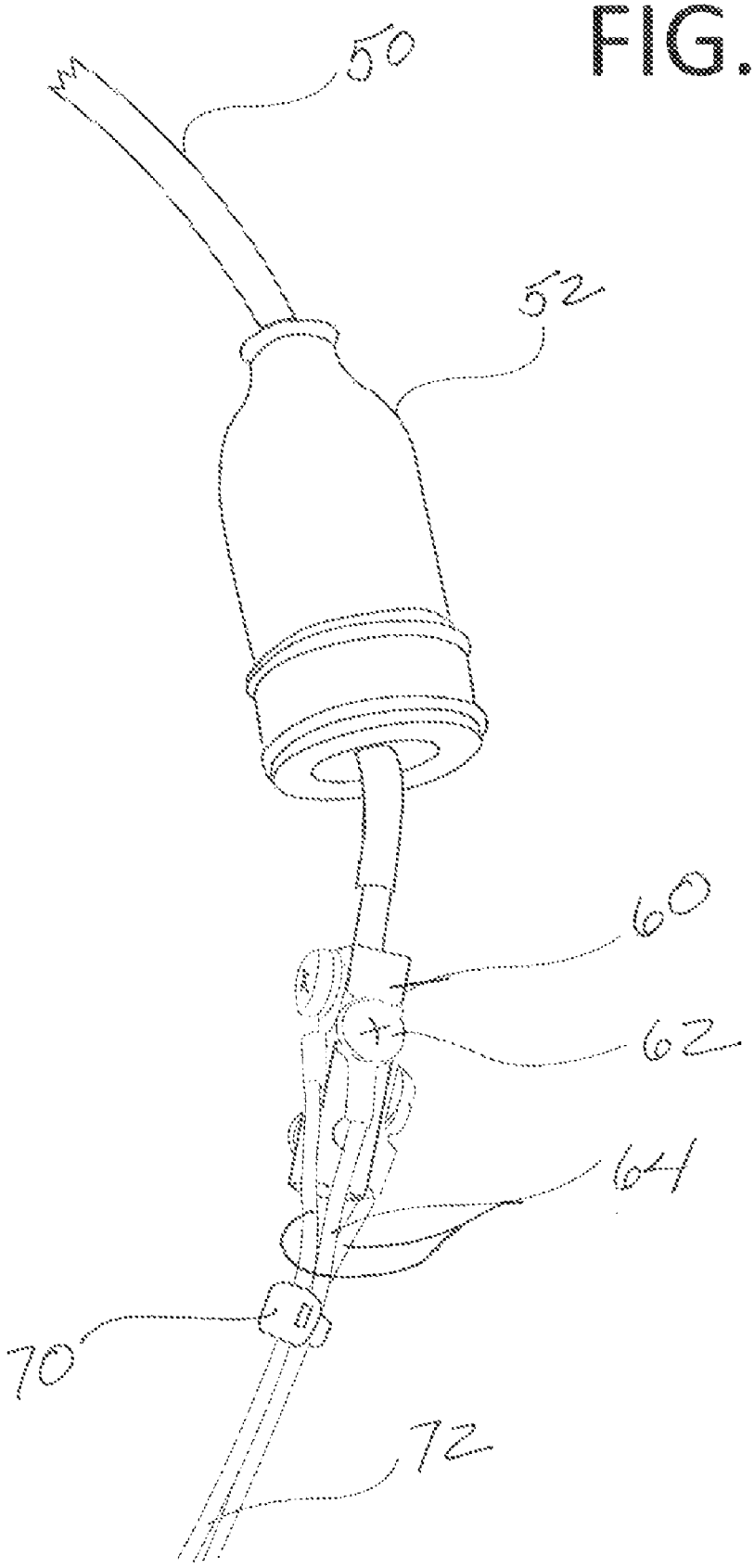
FIG. 3 illustrates a conductive terminal block from within its normal sleeved position, showing where the appliance wires connect.

FIG. 3 shows the unique terminal block 60 with a full complement of appliance wires 64 connected thereto. These wires are connected in a non-90° configuration, so that it can be sleeved over by the rubber boot 52, saving a great deal of space over the prior art type of fuseblocks commonly used in much larger vehicles. As each of the appliance wires 64 is connected, they can be pulled together as a wire bundle 72 by tic wrap 70. The reason that the non-90° configuration can be helpful is because a conventional 90° configuration takes up too much space for proper utilization in the context of the vehicles listed above. A normal 90° configuration won't fit underneath the seat of a vehicle like a motorcycle, ATV, UTV or snowmobile without hindrance. This new slimline design of the conductive metal terminal block 60 can fit into much smaller spaces, and is easy to install.

Figure 4:
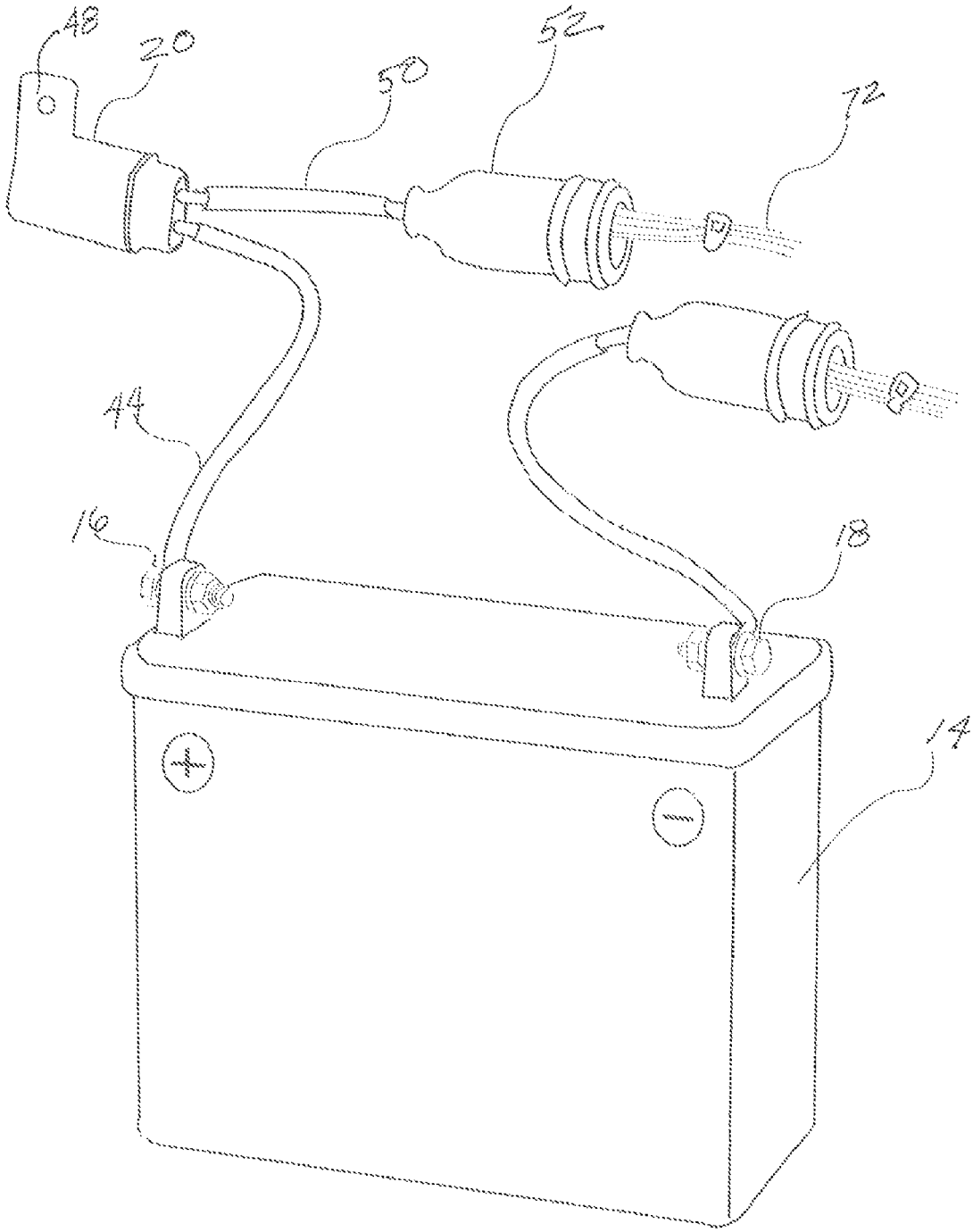
FIG. 4 is a perspective view of the present invention as it may be connected to a vehicle battery.

FIG. 4 illustrates the wiring configuration initially shown with respect to FIG. 1, but in more detail. Like numerals are used for FIGS. 2 through 4, and the fuse assembly 20 is shown attached to positive terminal 16 of the vehicle battery 14 by wire 44. Coming out of the fuse assembly 20 is wire 50 terminating within and extending into rubber hoot 52. Wire bundle 72 comes off the terminal block, which is not seen here because rubber hoot 52 is sleeved thereover. The individual wires from wire bundle 72 are each terminated therein, and then they extend up to either a socket (as shown in FIG. 1), or directly to an appliance.

In summary, numerous benefits have been described which result from employing any or all of the concepts and the features of the various specific embodiments of the present invention, or those that are within the scope of the invention. The remote battery terminal expander acts as a safe, easy-to-install and quick means for powering all the appliances any vehicle operator could ever want.

The foregoing description of a preferred embodiment of the invention has been presented for purposes of illustration and description. It is not intended to be exhaustive or to limit the invention to the precise form disclosed. Obvious modifications or variations are possible in light of the above teachings with regards to the specific embodiments. The embodiment was chosen and described in order to best illustrate the principles of the invention and its practical applications to thereby enable one of ordinary skill in the art to best utilize the invention in various embodiments and with various modifications as are suited to the particular use contemplated. It is intended that the scope of the invention be defined by the claims which are appended hereto.

What is claimed is:

1. A remote battery terminal expander for electrically connecting a plurality of appliances to a vehicle battery, comprising:

an electrical terminator assembly having a permanent electrical communication with a wire, said terminator being adapted for electrical connection to the positive terminal of a battery;

a conductive metal terminal block having a multi-sided block shape with alternating threaded apertures in each of the sides for receiving threaded fasteners to electrically secure appliance wires from various of the plurality of appliances desired to be hooked to the vehicle battery for its power requirements;

a fuse assembly in electrical communication between the electrical terminator assembly and the conductive metal terminal block; whereby appliance wires can be secured to the terminal block in a non-90° configuration, such that space is saved and a multitude of connections can be made in a small amount of space, without stacking all the connectors onto the positive battery terminal.

2. The battery terminal expander of claim 1, wherein the electrical-terminator assembly is terminated with a terminator selected from the group consisting of fork terminals and ring terminals.

3. The battery terminal expander of claim 1, wherein the wire includes an 18 AWG to 12 AWG wire.

4. The battery terminal expander of claim 1, wherein the wire has a temperature range of from 80° C. to 125° C.

5. The battery terminal expander of claim 1, wherein the wire includes one red wire 12 AWG with 105° C. that is PVC covered wire.

6. The battery terminal expander of claim 1, wherein the conductive metal terminal block is made of any conductive material selected from the group consisting of copper, gold, silver, their alloys, and combinations thereof.

7. The battery terminal expander of claim 1, wherein the conductive metal terminal block is made of an elongated rectangularly-sided block shape.

8. The battery terminal expander of claim 1, wherein the conductive metal terminal block is made of an elongated rectangularly-sided block shape.

9. The battery terminal expander of claim 1, wherein the fuse assembly is constructed of a circuit breaker selected from the group consisting of fuses, circuit breakers, electronic cut-off switches, and thermally re-settable circuit breakers.

10. A remote battery terminal expander for electrically connecting a plurality of appliances to a vehicle battery, comprising:

an electrical terminator assembly having a permanent electrical communication with one red wire 12 AWG with 105° C. that is PVC covered wire, said terminator being adapted for electrical connection to the positive terminal of a battery;

a copper conductive metal terminal block having an elongated rectangularly-shaped block shape with flat sides have alternating threaded apertures in each of the flat sides for receiving threaded fasteners to electrically secure appliance wires from various of the plurality of appliances desired to be hooked to the vehicle battery for its power requirements;

a fuse assembly in electrical communication between the electrical terminator assembly and the conductive metal terminal block; whereby appliance wires can be secured to the terminal block in a non-90° configuration, such that space is saved and a multitude of connections can be made in a small amount of space, without stacking all the connectors onto the positive battery terminal.

11. The battery terminal expander of claim 10, wherein the wire includes an 18 AWG to 12 AWG wire.

12. The battery terminal expander of claim 10, wherein the conductive metal terminal block is made of any conductive material selected from the group consisting of copper, gold, silver, their alloys, and combinations thereof.

13. The battery terminal expander of claim 10, wherein the fuse assembly is constructed of a circuit breaker selected from the group consisting of fuses, circuit breakers, electronic cut-off switches, and thermally re-settable circuit breakers.

14. A remote battery terminal expander for electrically connecting a plurality of appliances to a motorcycle battery, comprising:

an electrical terminator assembly having a permanent electrical communication with one red wire 12 AWG with 105° C. that is PVC covered wire, said terminator being adapted for electrical connection to the positive terminal of a motorcycle battery;

a copper conductive metal terminal block having an elongated rectangularly-shaped block shape with flat sides have alternating threaded apertures in each of the flat sides for receiving threaded fasteners to electrically secure appliance wires from various of the plurality of appliances desired to be hooked to the vehicle battery for its power requirements;

a motorcycle fuse assembly in electrical communication between the electrical terminator assembly and the conductive metal terminal block; whereby appliance wires can be secured to the terminal block in a non-90° configuration, such that space is saved within the frame of the motorcycle and a multitude of connections can be made in a small amount of space, without stacking all the connectors onto the positive battery terminal.

15. The battery terminal expander of claim 14, wherein the wire includes an 18 AWG to 12 AWG wire.

16. The battery terminal expander of claim 14, wherein the conductive metal terminal block is made of any conductive material selected from the group consisting of copper, gold, silver, their alloys, and combinations thereof.

17. The battery terminal expander of claim 14, wherein the fuse assembly is constructed of a circuit breaker selected from the group consisting of fuses, circuit breakers, electronic cut-off switches, and thermally re-settable circuit breakers.

* * * * *